United States Patent [19]

Swann et al.

[11] Patent Number: 4,470,336

[45] Date of Patent: Sep. 11, 1984

[54] ARMORED MISSILE LAUNCH/SHIPPING CONTAINER

[75] Inventors: Lynn J. Swann, La Verne; Larry D. Wedertz, Mira Loma, both of Calif.

[73] Assignee: General Dynamics, Pomona Division, Pomona, Calif.

[21] Appl. No.: 405,484

[22] Filed: Aug. 5, 1982

[51] Int. Cl.³ ..... F41F 3/04

[52] U.S. Cl. ..... 89/1.815; 89/1.816; 89/1.819

[58] Field of Search ..... 89/1.815, 1.816, 1.817, 89/1.819, 1.8, 1.806

[56] References Cited

U.S. PATENT DOCUMENTS

| | | | |
|---|---|---|---|
| 2,608,132 | 8/1952 | Lauritsen | 89/1.819 |
| 2,792,756 | 5/1957 | Schneiter | 89/1.819 |
| 2,961,927 | 11/1960 | Dufour | 89/1.816 |
| 3,072,020 | 1/1963 | Barnes et al. | 89/1.819 |
| 3,106,132 | 10/1963 | Biermann et al. | 89/1.815 |
| 3,135,162 | 6/1964 | Kamalian | 89/1.81 |
| 3,170,371 | 2/1965 | Zimmer et al. | 89/1.819 |
| 3,319,522 | 5/1967 | Gould et al. | 89/1.815 X |
| 3,406,606 | 10/1968 | Schöffl | 89/1.815 |
| 3,446,112 | 5/1969 | Planitzer et al. | 89/1.815 |
| 3,459,100 | 8/1969 | Pfister | 89/1.816 |
| 3,789,729 | 2/1974 | Aupy | 89/1.819 X |
| 3,865,009 | 2/1975 | Kongelbeck | 89/1.815 |
| 4,166,406 | 9/1979 | Maughmer | 89/1.815 |
| 4,306,486 | 12/1981 | Oswell | 89/1.816 |

*Primary Examiner*—David H. Brown

*Attorney, Agent, or Firm*—Neil F. Martin; Freling E. Baker; Edward B. Johnson

[57] ABSTRACT

A missile launch system includes a missile launch support structure mounted on a launch platform and including a pair of spaced apart rails having longitudinal slots formed therein, and a cooperating missile launch container having a cylindrical bore for receiving and supporting a missile for launching includes radially extending ribs spaced and oriented to engage and slide along the slots in the rails for supporting the missile launch container for launching of the missile.

26 Claims, 6 Drawing Figures

ARMORED MISSILE LAUNCH/SHIPPING CONTAINER

BACKGROUND OF THE INVENTION

The present invention relates to missile launchers and pertains particularly to missile transporting and launching structure.

The fire power of a missile unit depends to a large extent upon the speed with which the missile launching systems can be reloaded. Missiles are usually fired from a launch tube which frequently also serves as the shipping container for the missile. Such arrangements are satisfactory so long as the launch tubes can be quickly replaced or reloaded. The reloading of a tube with a missile is a time consuming endeavor.

It is desirable when possible for the missile shipping container to also serve as the launch tube for the missile. This has numerous advantages including maintaining the missile free of dust and contamination and also the elimination of the need for handling of the missile numerous times.

Such missile systems, however, to be effective must have an expendable launch tube but also include a quick mounting and demounting structure. The system must also have simple and reliable means for quickly positioning and properly orienting the launch tube for the missile.

It is therefore desirable that a simple inexpensive system be available that utilizes the shipping container for a missile as its launch tube with an arrangement for quickly and effectively replacing the launch tube.

SUMMARY AND OBJECTS OF THE INVENTION

It is therefore the primary object of the present invention to provide missile launch and shipping container.

In accordance with the primary aspect of the present invention, a missile launch system includes a support structure having elongated parallel rails having guide means therein for receiving cooperating ribs of a missile shipping launch container for mounting and supporting the missile for launch.

BRIEF DESCRIPTION OF THE DRAWINGS

The above and other objects and advantages of the present invention will become apparent from the following description when read in conjunction with the drawings wherein.

DETAILED DESCRIPTION OF PREFERRED EMBODIMENTS

Figure 1:
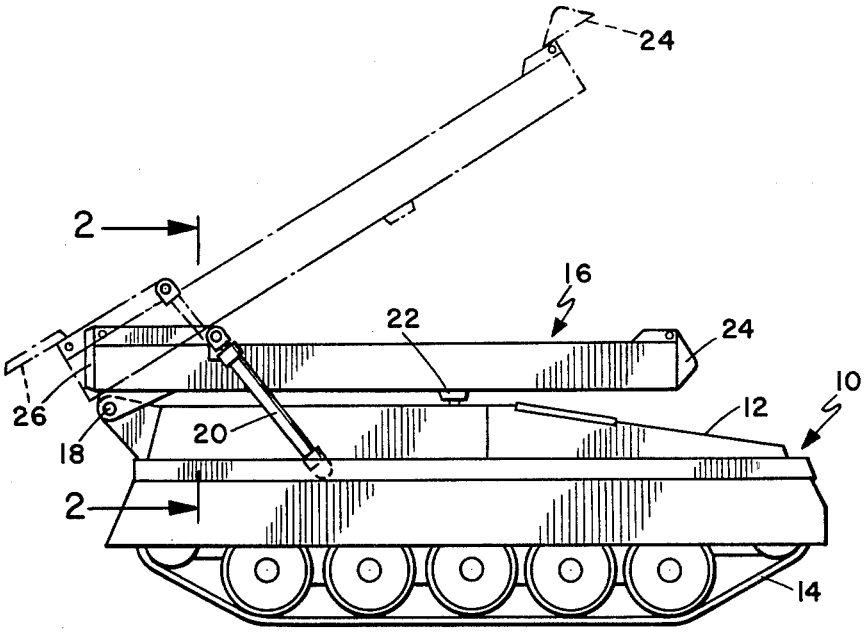
FIG. 1 is a side elevation view of a typical vehicle and launcher adapted to use the missile shipping and launch containers.
Figure 2:
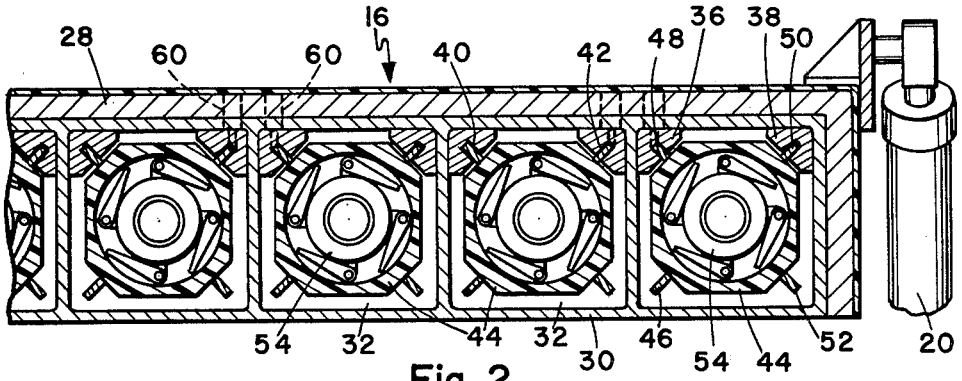
FIG. 2 is an enlarged sectional view taken on line 202 of FIG. 1.

Turning to the drawings, a missile launching system designated generally by the numeral 10 is illustrated in FIG. 1 and includes an armored track vehicle including a chassis 12 with endless tracks 14 serving as the launch platform. The missile launch support structure includes, in the illustrated embodiment, an elongated flat box-like structure 16 pivotally mounted by pivot bracket including a pivot pin 18 on the rear of the vehicle and includes lift cylinders 20 for raising the launch support structure to an inclined position from the horizontal for firing and for loading and unloading. The launch structure includes a snubber assembly 22 for securing the launch support structure to lock down the system in a substantially horizontal orientation or position when not in use. Fore and aft dust covers 24 and 26 cover the launcher support housing.

The missile support structure itself, in the illustrated embodiment, comprises a generally box-like armored or armor-shielded structure including armor plate or shielding 28 surrounding a multi-compartment box-like structure 30 having a plurality of elongated generally square tubular open ended mounting chambers or channels 32. These are illustrated as lying in a common plane. A pair of mounting rails 36 and 38 are mounted in each of the chambers 32 extending length-wise thereof in two adjacent corners. In the illustrated box-like structure, these rails 36 and 38 are positioned in the uppermost corners of the chamber and each rail includes a respective slot or channel 40 and 42 extending lengthwise the length thereof. The slots 40 and 42 are preferably slightly tapered in width to receive similarly tapered ribs on a missile launch container as will be described.

These slots 40 and 42 support a missile shipping and launch container 44 having a plurality, more particularly, four substantially identical ribs 46, 48, 50 and 52 extending radially outward therefrom at equal amgular positions (about 90° from one another) around the central axis thereof. These ribs are slightly tapered to cooperatively engage similarly slightly tapered grooves or slots in the rails 36 and 38. Because of the angle thereof, the missile launch tube 44 is held in position in the chamber 32. A missile 54 packaged and shipped in the container remains in the container until launched.

Figure 3:
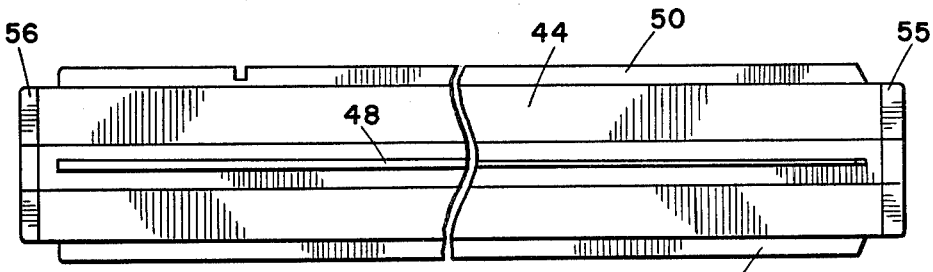
FIG. 3 is a side view of the missile shipping and launch container.
Figure 4:
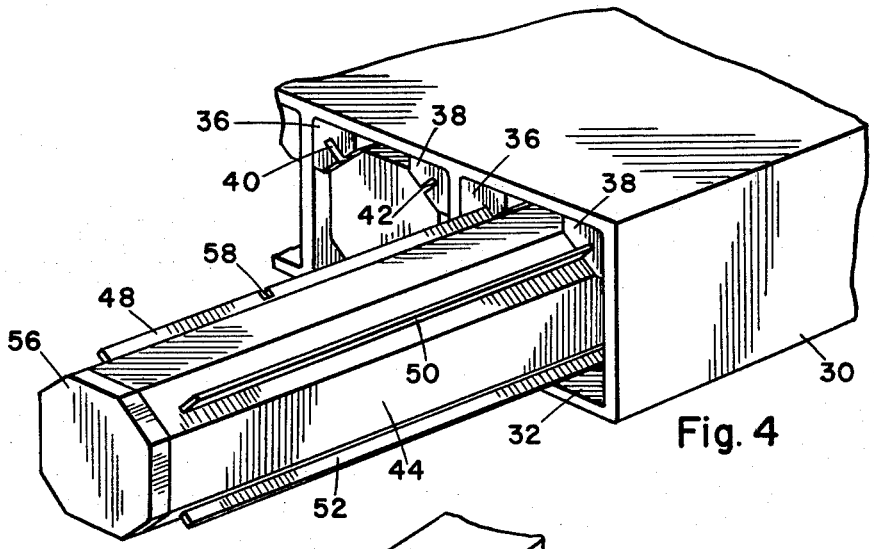
FIG. 4 is a perspective view showing a shipping and launch container being loaded into a launcher.

As best seen in FIG. 3, the container includes covers 54 and 56 over the fore and aft ends of the launch tube. The ribs or at least one or more thereof includes a notch 58 for receiving a retaining pin or pawl for retaining the launch tube in position in the rail. Preferably the rails are tapered from the aft end to the forward end, similarly matching similar tapers of the slots in the rails 36 and 38 to thereby ease the insertion of the launch tube into the slots or grooves of the rails. This also prevents the mounting of the tubes backwards in the support.

In operation, in order to load the launch support assembly, a plurality of missiles in their shipping containers are selected and each placed with the ribs of the containers aligned with the slots of the rails and slid into the respective mount chamber. The support assembly may be positioned in its downward position as shown in FIG. 1 or in a raised position as shown in phantom in FIG. 1 as desired. The containers are slid into position and the retaining pins 60 snap into the retaining notches 58 for retaining the missile shipping launch tube into position. One or all rails may contain a notch as desired. Preferably, all four ribs include a notch such that orientation of the ribs other than alignment with the slots in the support rails is not a factor.

Once the missiles have been launched from their containers, the support structure need only be lifted as shown in phantom in FIG. 1 and the latch pins released, permitting the spent missile container launch tubes to slide from the respective chambers. The chambers then are reloaded with a fresh missile shipping launch container.

This provides a simple and inexpensive missile shipping and launch assembly that is quick and easy to load and unload. The spent containers may be either discarded or reloaded as desired.

Figure 5:
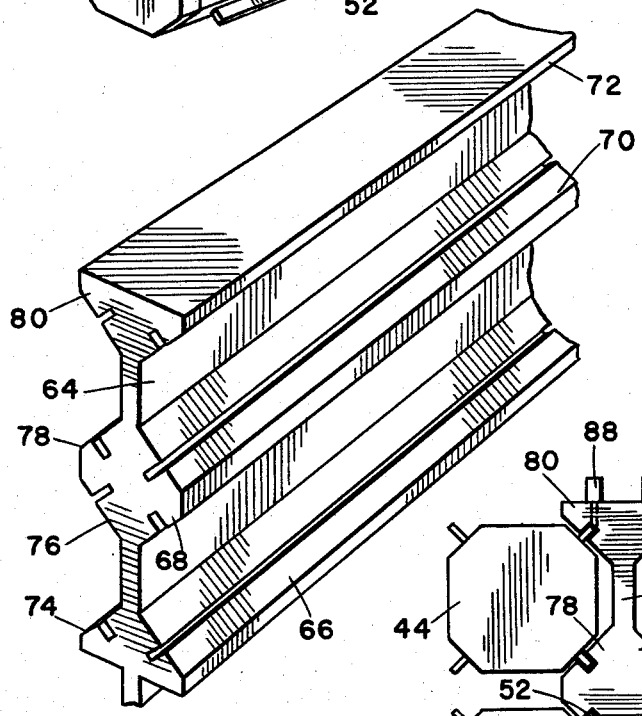
FIG. 5 is a perspective view of a portion of an alternative launch rack for holding missile containers externally.
Figure 6:
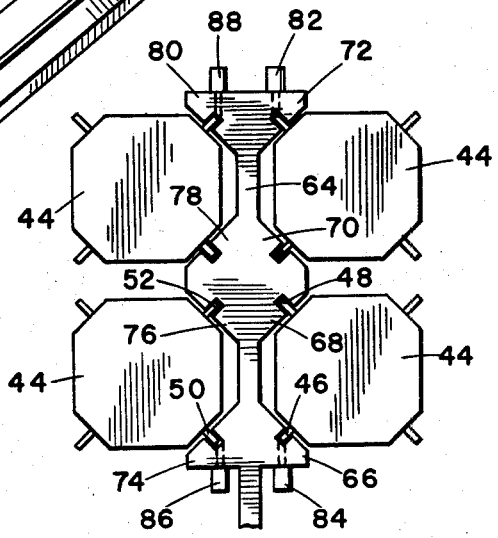
FIG. 6 is an end view of the rack of FIG. 5 with missile containers in place.

Turning to FIG. 5, an alternate embodiment is illustrated wherein a support structure which may be either vertically or horizontally oriented comprises a central wall or plate member 64 having opposed pairs of slotted rails 66, 68, 70 and 72 on one side of the wall or plate member and similar pairs of slotted rails 74, 76, 78 and 80 on the opposite side of the wall or plate. As shown in FIG. 6, each of the slotted rails receive a respective rib 46 or 48, 50 or 52 of a missile launch shipping container 44.

A plurality of latch members or pin assemblies 82, 84, 86 and 88 are positioned for engagement with at least one rib of a respective missile launch shipping container. These pin assemblies may be either air, hydraulic or electrically operated for release of the pin and thereby release of the container from its respective rail.

The above described arrangement provides a simple inexpensive and effective missile shipping and launching asembly which is quick and easy to load and unload on the launch structure. The shipping launch containers may be expended or retrieved for recycling as desired.

While we have illustrated and described our invention by means of a specific embodiment, it is to be understood that numerous changes and modifications may be made therein without departing from the spirit and scope of the invention as defined in the appended claims.

We claim:

1. A missile launch systems comprising:

a missile launch container having a cylindrical bore for receiving and supporting a missile for launching, a missile launch support structure including a pair of spaced apart rails for releasably supporting a missile launch container, and said missile launch container including a pair of spaced apart rail engaging members disposed at about a 90° angle to one another about the axis of said cylindrical bore for engaging said rails for supporting said container on said rails.

2. The missile system of claim 1 including latch means associated with said rails for engaging and latching said rail engaging members in position in said rails.

3. The missile launch system of claim 1 wherein said rails each include an elongated slot, and said rail engaging members engaging and being supported in said slot.

4. The missile launch system of claim 3 wherein said rail engaging member is an elongated rib extending radially outward and longitudinally along the outer surface of said launch container.

5. The missile launch system of claim 4 wherein said ribs are tapered along the length thereof.

6. The missile launch system of claim 5 wherein said elongated slots are tapered in width from one end toward the other.

7. The missile launch system of claim 6 comprising latch means for latching said container in position on said rails.

8. The missile launch structure of claim 6 wherein said launch support structure comprises a plate disposed in a vertical plane and having a plurality of rails on each side thereof.

9. The missile launch structure of claim 8 including latch means for engaging and retaining said ribs in said rails.

10. The missile launch system of claim 6 wherein:

said launch support structure comprises a housing having a plurality of parallel open ended compartments, and a pair of said rails are disposed in each compartment.

11. The missile launch system of claim 10 wherein said compartments are disposed in a common plane.

12. The missile launch system of claim 10 wherein said housing is pivotally mounted for orientation from a horizontal to a vertical angle.

13. The missile launch system of claim 12 wherein said compartments are of a generally square tubular configuration; and said rails are mounted in the top corners of said compartments.

14. The missile launch system of claim 13 wherein said slots open toward the center of the compartments.

15. The missile launch system of claim 14 wherein said housing is shielded by armor.

16. A missile launch system comprising:

a missile launch container having a cylindrical bore for receiving and supporting a missile for launching, a missile launch support structure including a pair of spaced apart rails each including an elongated slot for releasably supporting a missile launch container, and said missile launch container including spaced apart rail engaging elongated ribs extending radially outward and longitudinally along the outer surface of said launch container for engaging said rails for supporting said container on said rails wherein said container includes four ribs equally angularly positioned about the axis of said container.

17. The missile launch system of claim 16 comprising latch means for latching said container in position on said rails.

18. The missile launch structure of claim 16 wherein said launch support structure comprises a plate disposed in a vertical plane and having a plurality of rails on each side thereof.

19. The missile launch system of claim 16 wherein said ribs are tapered along the length thereof.

20. The missile launch system of claim 19 wherein said elongated slots are tapered in width from one end toward the other.

21. The missile launch system of claim 16 wherein:

said launch support structure comprises a housing having a plurality of parallel open ended compartments, and a pair of said rails are disposed in each compartment.

22. The missile launch system of claim 21 wherein said housing is pivotally mounted for orientation from a horizontal to a vertical angle

23. The missile launch system of claim 21 wherein said compartments are of a generally square tubular configuration; and said rails are mounted in the top corners of said compartments.

24. The missile launch system of claim 21 wherein said slots open toward the center of the compartments.

25. The missile launch system of claim 21 wherein said housing is shielded by armor.

26. The missile launch system of claim 21 wherein said compartments are disposed in a common plane.

* * * * *